United States Patent [19]

Delaino

[11] Patent Number: 4,769,865

[45] Date of Patent: Sep. 13, 1988

[54] WATERBED MATTRESS CORNER ACCESSORY

[76] Inventor: G. Thomas Delaino, 3316 NW. 5th Ave., Gainesville, Fla. 32607

[21] Appl. No.: 21,188

[22] Filed: Mar. 3, 1987

[51] Int. Cl.[4] ..... A47C 21/02

[52] U.S. Cl. ..... 5/504; 5/508; 24/72.5

[58] Field of Search ..... 5/508, 451, 504, 503, 5/411, 498, 496; 24/72.5

[56] References Cited

U.S. PATENT DOCUMENTS 4,539,723 9/1985 Hillsberry ..... 5/508

4,624,022 4/1986 Dolan ..... 5/508

*Primary Examiner*—Alexander Grosz

*Attorney, Agent, or Firm*—Arthur G. Yeager

[57] ABSTRACT

An accessory to be used with a waterbed to form a corner to facilitate the application of and retention of bed clothes thereto which includes a rigid structure having a bottom horizontal surface and two vertical side surfaces intersecting each other at right angles to form a pyramidal apex adapted to fit into the corner of a bed frame holding the waterbed bladder mattress, and a surface to receive the weight of a corner of the mattress tending to push the accessory into the corner of the bed frame with the bed clothes sandwiched between the bottom and side surfaces and the bed frame.

19 Claims, 2 Drawing Sheets

WATERBED MATTRESS CORNER ACCESSORY

BACKGROUND OF THE INVENTION

The present invention relates to an accessory to facilitate the placing of sheets and/or other bed covers on a waterbed and for retaining these covers in position until they are intentionally removed.

The waterbed is a large, fluid filled rectangular bladder supported by a base platform with four vertical sides to form the bed frame as an open top rectangular box. This bladder has poorly defined corners which appear and disappear with movement of the internal fluid when a person enters, exits or moves from side to side in the bed. The poorly defined corners and the weight of the mattress make it difficult to place sheets on the bed. The fluid movement, even on models having internal flow restrictions will cause the sheets to slip partially or totally off of the mattress.

Even specially designed fitted sheets are difficult to use because the mattress is very heavy to lift and, when it is lifted, the fluid flows away from the corner leaving an empty bladder corner to be placed in the sheet corner, and when the bladder corner is lowered to the bed frame, the fluid returns and pushes the sheet aside. The problem is compounded when an attempt is made to place more than one bed cover on the mattress. Padded mattress covers are highly recommended to improve the comfort of the waterbed. However, they are almost impossible to place and hold into position along with the sheets. Even if one is successful in finally tucking the bed clothes into place, the next movement of the mattress is very likely to at least partially dislodge them, resulting in excessive wrinkling of the sheet and mattress pad.

Attempts by the prior art to solve the problems defined above have generally fallen into two categories. The first category involves the redesign of the mattress (illustrated by U.S. Pat. Nos. 4,186,455 and 4,615,060) or the redesign of the supporting frame (illustrated by U.S. Pat. No. 4,057,862). These solutions are very expensive and ignore the existing inventory of waterbeds. The second category involves holding the bed covers in position by use of buttons (U.S. Pat. No. 4,521,970), hook and loop type fastener, such as the ones used under the trademark of Velcro (U.S. Pat. No. 4,040,133) or clips (U.S. Pat. No. 4,520,518) that hook to the bed covers. These solutions are, at best, only partially effective since they deal with only a single cover, e.g., a sheet, but do not apply to multiple bed covers. Furthermore, these solutions create a stress point on each corner that is likely to result in detachment or tearing of the material. Another device for holding the corner of a sheet is shown in U.S. Pat. No. 4,624,022.

BRIEF SUMMARY OF THE INVENTION

In one aspect the waterbed accessory forms a removable corner between a waterbed bladder mattress and a bed frame and is formed of a rigid structure, four of which are required for a rectangular bed frame. Each structure includes a lower substantially horizontal surface and two substantially vertical surfaces which mutually intersect at right angles to form an apex with one vertical linear edge and two horizontal linear edges diverging outwardly therefrom. Also, the structure has another surface adapted to receive a corner portion of such mattress bearing downwardly by gravity thereon so that each of the two vertical and one horizontal surface contact bed clothes for such mattress thereby retaining same in position about the accessory.

Various other aspects include the formation of the structure into a right prism of two parallel end faces defining the lower surface and the other surface joined to three sides, two of which define the two vertical surfaces at right angles to each of the end faces. The structure preferably includes an upper generally horizontal small surface generally parallel to the lower surface, the upper small surface providing relief of stress on bed clothes engaged by the accessory to minimize damage thereto. The structure may be in the form of a pentahedron in the shape of a truncated three-sided pyramid, and even may be a hollow pentahedron formed by removing one side of such truncated three-sided pyramid. When the structure is a solid pentahedron, a large right triangular base defines the lower surface and a small right triangular top defines the upper small surface and joined by three trapezoidal sides, two of which are at right angles to each other and define the two vertical surfaces and at right angles to the base and top, and the third trapezoidal defines the other surface and is angularly inclined and includes the hypotenuse of each triangular base and top. The upper generally horizontal surface may be a convexly curved surface to minimize damage to the bed clothes and/or mattress. The structure may include another vertical surface joined to the two vertical surfaces and to the other surface to form a right prism.

Further aspects are seen wherein in one embodiment the other surface is parallel to the lower horizontal surface and forms therewith the bottom wall of the structure. In another embodiment the other surface is disposed generally oppositely and spaced apart from the apex and inwardly of a bed frame and intersects the horizontal surface and each of the vertical surfaces. In a further embodiment the other surface is slanted downwardly from adjacent the mutual intersection of the two vertical walls to the lower surface. In several embodiments the upper generally horizontal small surface is generally parallel to the lower surface and is adapted to be contacted by a corner portion of the mattress to enhance the vertical force being applied by gravity thereon and minimizing damage to bed clothes about the structure.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DESCRIPTION OF THE PREFERRED EMBODIMENTS

Figure 1:
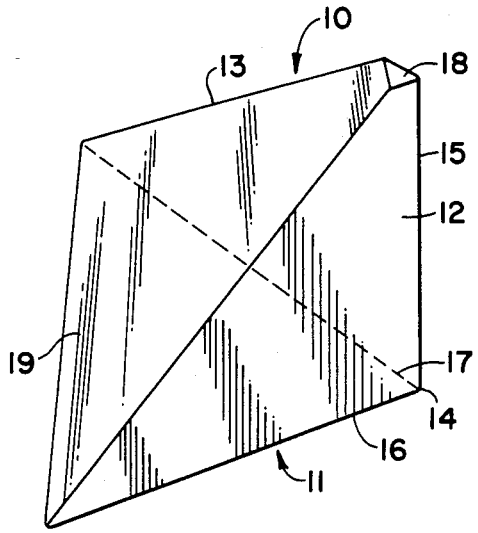
FIG. 1 is a perspective view of one embodiment of the present invention.

This invention is best understood by reference to the accompanying drawings. FIG. 1 is a perspective view of the preferred embodiment of this invention wherein accessory 10 is a right angled polyhedron of five sides, including a bottom horizontal planar surface 11 intersected at right angles by two vertical planar surfaces 12 and 13 to form edges 15, 16 and 17 that intersect at apex 14 which fits snugly into the corner of a bed frame. Front sloping surface 19 intersects the other three surfaces 11, 12 and 13 to form a pyramidal shape. At the top of the shape the apex has been cut off to form a small horizontal surface 18 generally parallel to bottom surface 11, although surface 18 may be sloping, rounded or the like. Surface 18 is designed to be blunt so as not to cause bed clothes to be torn when stretching thereover.

Figure 2:
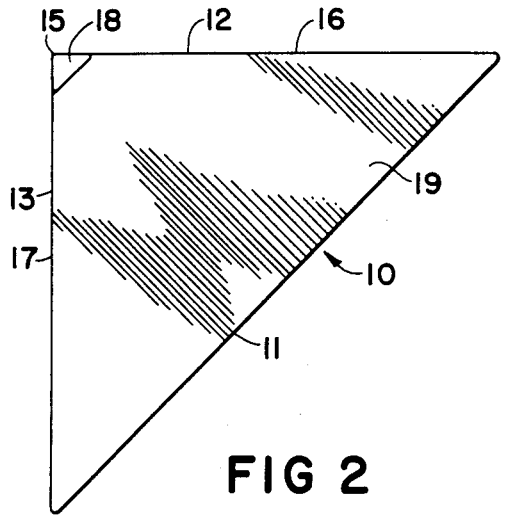
FIG. 2 is a top plan view of the embodiment shown in FIG. 1.
Figure 3:
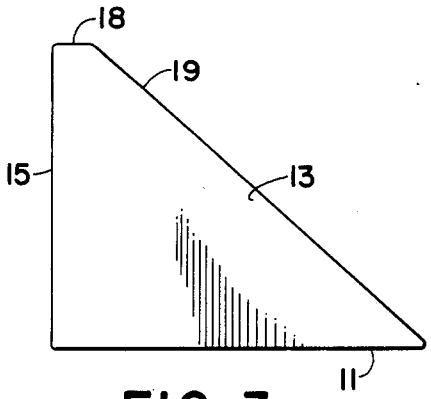
FIG. 3 is a side elevational view of the embodiment shown in FIG. 2.
Figure 4:
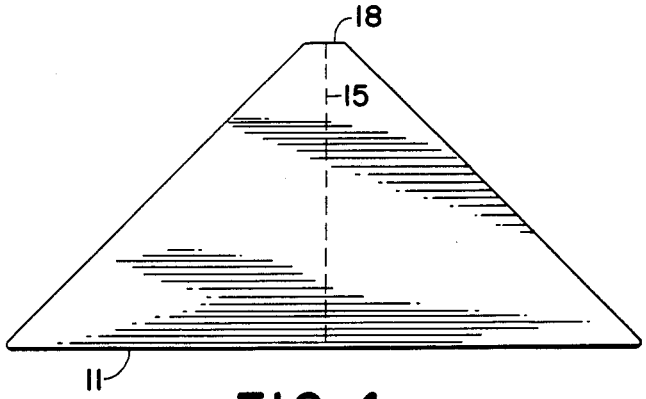
FIG. 4 is a front elevational view of the embodiment shown in FIG. 2.

FIG. 2 is a top plan view of the form of the invention as illustrated in FIG. 1. FIG. 3 is a side elevational view of the device of FIG. 2. FIG. 4 is a front elevational view of the device of FIG. 2. In these drawings the device is illustrated as a solid structure.

Figure 5:
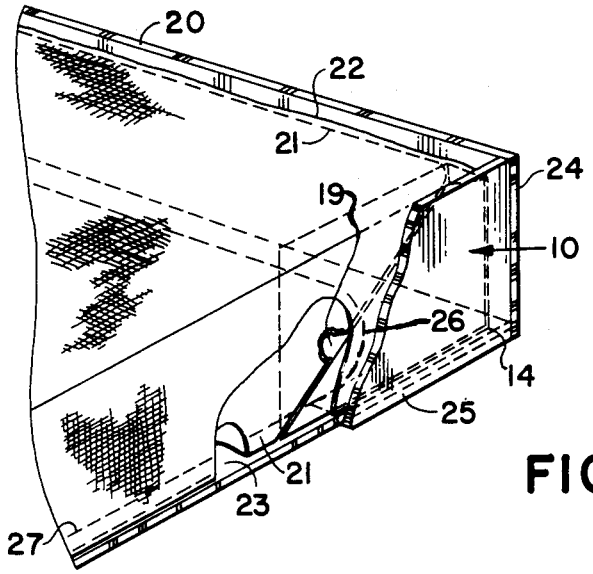
FIG. 5 is a perspective view of one form of the present invention, the embodiment of FIGS. 1–4 as used with a waterbed in a bed frame.

In FIG. 5 there is a perspective view, partially in cross section showing how this invention is used with a waterbed. Bed frame 20 is a rectangular box with an open top into which the waterbed bladder mattress 21 is placed. A fitted sheet 22 is to be placed around mattress 21. Corner device 10 is placed in the corner of bed frame 20 with apex 14 in the lower corner and sloping face 19 spaced away from apex inwardly of the bed frame 20 so that the corresponding corner of mattress 22 overlies surface 19 tending to push device 23 into the corner of the bed frame 20. Fitted sheet 22 with a corner pocket 26 receiving corner device 10 therewithin is pushed into the corner of the bed frame by the weight of water in mattress 21. The weight of water also bears down via surface 19 and bottom 11 upon sheet pocket 26 into engagement with the bottom 23 of bed frame 20 and keeps it from slipping off mattress 21 as the fluid moves around when those persons in bed move or turn over. Also, the sides of the sheet 22 which are engaged by surface 12 and 13 of accessory 10 are pressed against the respective sides 24 and 25 of the bed frame 20.

Figure 6:
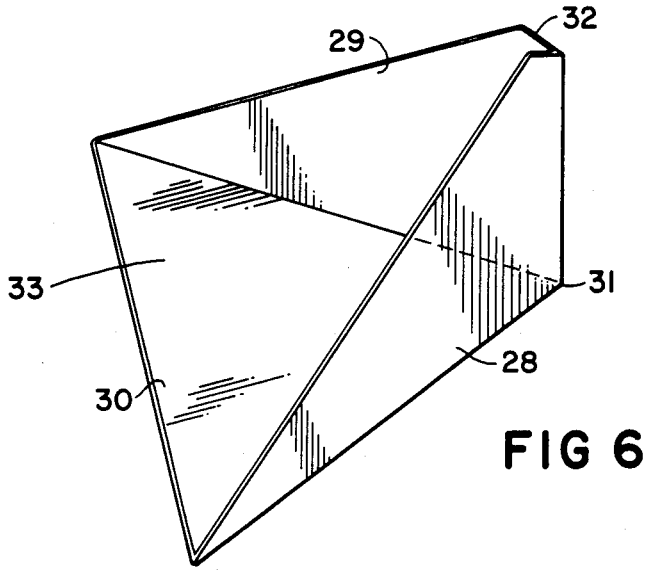
FIG. 6 is a perspective view of a second embodiment of this invention.

FIG. 6 shows a device of the same general shape as that of FIGS. 1–4 but is hollow rather than solid. In this embodiment, the device is formed of three thin walls 28, 29, and 30, joined together at right angles to produce a hollow triangular pyramid having an apex 31 and an open front 33. Apex 31 fits into the lower corner of a bed frame and the corner of the mattress fits into open front 33 to lie on the upper surface of wall 30. Upper corner 32 of the device is truncated to produce a blunt corner over which a sheet or a mattress cover could be stretched without much risk of becoming torn. For purpose of ease of packaging and shipment in a flat condition, walls 28 and 29 adjacent the respective right angles may hingedly connect with wall 30, leaving open the connection between walls 28 and 29, without departing from the spirit or scope of the invention herein disclosed.

Figure 7:
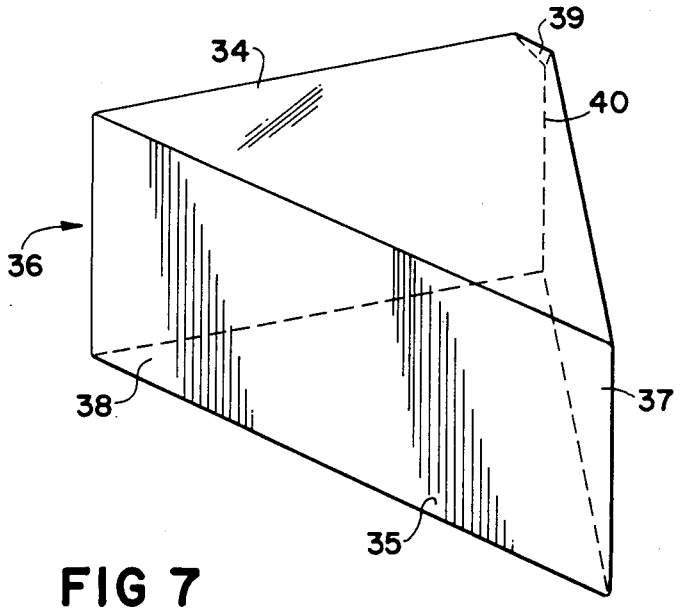
FIG. 7 is a perspective view of a third embodiment of this invention.

FIG. 7 is a perspective view of a third embodiment of the invention. This embodiment has no apex but rather is in the form of a triangular prism having upper horizontal surface 34 parallel with and spaced apart from lower horizontal surface 35, both of which are joined at right angles to both of side vertical surfaces 36 and 37. These surfaces intersect in vertical edge 40 which fits into a corner of a bed frame. Diagonal surface 38 is spaced inwardly away from edge 40 and is the contact for the waterbed bladder mattress. Upper corner 39 is cut off to form a rounded blunt corner which may be convexly curved so the sheet or mattress cover stretched thereover will not be damaged.

Two techniques are available for utilizing the corner stabilizing devices of this invention to ease the process of placing sheets and/or other bed covers on a waterbed. The first technique would be to position a device in each of the four corners of the waterbed similar to that shown in FIG. 5. The sheet and/or bed covers are then tucked around and under the corners in much the same manner used when placing sheets on a normal inner-spring bed. This technique would be necessary if conventional (flat) bed covers are being used. It also works well when using fitted waterbed sheets and/or other bed covers.

The second technique entails the placement of the corner stabilizing device inside the fitted corner of the waterbed sheets and/or other bed covers. The waterbed mattress is then rolled back away from the corner of the retaining frame to allow the stabilizing device (with bed covers) to be placed in the corner. The mattress is then released and allowed to roll back against or onto the stabilizing corner. This technique is very useful when placing more than one bed cover (i.e., a sheet and mattress cover) on the waterbed or when placing bed covers on a waterbed that has been positioned in a corner of a room, thereby restricting access to one corner of the waterbed.

The accessories or devices of this invention may be solid or hollow and may be made of wood, metal, plastic, or the like. Foamed plastic solids are particularly desirable because of ease of manufacture, and lightness of weight. Preferred sizes of these devices are those that are convenient for the bed frames now in use. Generally the device should be from about 6–10 inches in height, preferably about 8 inches; and each leg of the bottom surface, e.g., edges 16 and 17 of FIG. 1, to be about 10–15 inches long, preferably about 12 inches. Preferably the vertical height of the devices are at least reduced from the normal height of the waterbed bladder mattress by about one inch. An attendant advantage is provided when the height of the accessory is about one-third of the mattress height; namely, the mattress will overlay the small upper surface 18 and provide an enhancement of the gravitational force onto the accessory. While the devices of this invention are shown as having several sharp corners, it is understood that all of the corners of the devices disclosed herein should be rounded to minimize damage to bed clothes and/or the bladder mattress.

While the invention has been described with respect to certain specific embodiments, it will be appreciated that many modifications and changes may be made by those skilled in the are without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A waterbed accessory adapted to form a corner comprising a rigid structure adapted to be placed in a corner of a bed frame into which a waterbed bladder mattress is contained and including a lower horizontal planar surface and two vertical planar surfaces which mutually intersect at right angles to form an apex with one vertical linear edge and two horizontal linear edges diverging outwardly therefrom, an upper substantially horizontal small surface spanning said linear edges adjacent said apex on said structure substantially parallel to said lower horizontal planar surface, and a surface means spaced apart from said apex and inwardly of said bed frame and intersecting said lower horizontal planar surface and both said vertical surfaces, said surface means being adapted to receive a portion of said bladder mattress bearing downwardly by gravity thereon.

2. The accessory of claim 1 wherein said structure is a pentahedron in the shape of a truncated three-sided pyramid.

3. The accessory of claim 1 wherein said structure is in the form of a hollow pentahedron in the shape of a truncated three-sided pyramid.

4. The accessory of claim 1 wherein said rigid structure is a solid pentahedron having a large right triangular base and a small right triangular top joined by three trapezoidal sides, two of which are at right angles to each other and to said base and said top, and the third trapezoidal surface being angularly inclined and including the hypotenuse of each said triangular base and said triangular top.

5. The accessory of claim 1 wherein said upper substantially horizontal member is a convexly curved surface.

6. The accessory of claim 1 wherein said surface means includes an upper large planar surface extending substantially parallel to said lower planar surface and another planar surface intersecting said upper large planar surface and said two vertical planar surfaces with all of said surfaces forming a truncated right prism.

7. The accessory of claim 1 wherein said surface means includes a planar surface.

8. A corner-forming accessory to assist in applying and retaining bed clothes to a waterbed bladder mattress, said accessory comprising a rigid solid pentahedron having a large right triangular horizontal bottom surface and a small right triangular horizontal top surface parallel thereto, two right angled trapezoidal vertical side surfaces joining said top and bottom surfaces at right angles and joining each other at right angles to form an apex, and a sloping trapezoidal surface joining said top and bottom surfaces and said side surfaces, said apex being adapted to fit into a corner of a bed frame holding a waterbed bladder mattress and said sloping surface adapted to be overlaid by a corner of a waterbed bladder mattress, each of said two vertical side surfaces and said bottom surface being adapted to contact bed clothes for a waterbed bladder mattress thereby retaining same in position about said accessory.

9. A waterbed accessory adapted to form a corner comprising a rigid structure adapted to be placed in a corner of a bed frame into which a waterbed bladder mattress is contained and including a lower substantially horizontal surface and two substantially vertical surfaces which mutually intersect at right angles to form an apex with one vertical linear edge and two horizontal linear edges diverging outwardly therefrom, each of said vertical surfaces having an upper edge extending substantially in the same direction as respective said horizontal linear edge, an upper generally horizontal small surface generally parallel to said lower surface, said upper small surface providing relief of stress on bed clothes engaged by said accessory to minimize damage thereto and an upper large surface spaced above said lower horizontal surface and connected to each said upper edge and adapted to receive a corner portion of a waterbed bladder mattress bearing downwardly by gravity thereon, each of said two vertical and horizontal surfaces being adapted to contact bed clothes for a waterbed bladder mattress thereby retaining same in position about said accessory.

10. The accessory of claim 9 wherein said rigid structure is in the form of a right prism of two parallel end faces defining said lower surface and said upper large surface joined to three sides two of which define said two vertical surfaces at right angles to each of said end faces.

11. The accessory of claim 9 wherein said rigid structure is a pentahedron in the shape of a truncated three-sided pyramid.

12. The accessory of claim 9 wherein said rigid structure is in the form of a hollow pentahedron formed by a truncated three-sided pyramid.

13. The accessory of claim 9 wherein said rigid structure is a solid pentahedron having a large right triangular base defining said lower surface and a small right triangular top defining said upper small surface and joined by three trapezoidal sides, two of which are at right angles to each other and defining said two vertical surfaces and at right angles to said base and said top, and the third said trapezoidal side defining said other surface and being angularly inclined and including the hypotenuse of each said triangular base and said triangular top.

14. The accessory of claim 9 further comprising another vertical surface joined to said two vertical surfaces and to said upper large surface.

15. The accessory of claim 14 wherein said upper large surface is substantially horizontal and parallel to said lower horizontal surface.

16. The accessory of claim 15 wherein said upper small surface is triangular and forms the intersection of said upper large surface and said two vertical surfaces.

17. The accessory of claim 9 wherein said upper large surface is parallel to said lower horizontal surface and forms therewith the bottom wall of said accessory.

18. The accessory of claim 9 wherein said upper large surface is disposed generally oppositely and spaced apart from said apex and inwardly of a bed frame and intersecting said horizontal surface and each of said vertical surfaces.

19. The accessory of claim 9 wherein said upper large surface is slanted downwardly from adjacent said upper small surface to said lower surface.

* * * * *